US005315785A

United States Patent [19]

Avôt et al.

[11] Patent Number: 5,315,785

[45] Date of Patent: May 31, 1994

[54] WRAPPING FOR PLANTS OR FLOWERS PLACED IN A POT LIKE CONTAINER

[76] Inventors: Bernardus J. M. M. Avôt, Puccinistraat 57, 2551 LK Den Haag; Anna P. M. van der Meer-van der Helm, Osdorperweg 951 A, 1067 SW Amsterdam, both of Netherlands

[21] Appl. No.: 798,315

[22] Filed: Nov. 26, 1991

[30] Foreign Application Priority Data

Nov. 26, 1990 [NL] Netherlands ..... 9002569

[51] Int. Cl.[5] ..... B65D 85/52

[52] U.S. Cl. ..... 47/72; 206/423; 229/4.5

[58] Field of Search ..... 47/72, 74, 84; 206/423; 229/4.5, 93, 87.5

[56] References Cited

U.S. PATENT DOCUMENTS

| | | | |
|---|---|---|---|
| 797,175 | 8/1905 | Collenburg | 47/72 |
| 1,828,448 | 10/1931 | Seidel | 206/423 X |
| 2,253,817 | 8/1941 | Simmons | 47/66 |
| 2,606,106 | 8/1952 | Albertson | 47/72 |
| 2,830,405 | 4/1958 | Nydegger | 47/84 |
| 3,021,046 | 2/1962 | Pullen | 47/84 |

FOREIGN PATENT DOCUMENTS

| | | | |
|---|---|---|---|
| 0163453 | 12/1985 | European Pat. Off. | 47/72 |
| 0262708B1 | 4/1988 | European Pat. Off. . | |
| 8004753 | 2/1980 | Fed. Rep. of Germany . | |
| 1412009 | 9/1964 | France . | |
| 2477107 | 9/1981 | France . | |
| 6713739 | 6/1967 | Netherlands . | |
| 8201851 | 5/1982 | Netherlands . | |

*Primary Examiner*—Carl D. Friedman
*Assistant Examiner*—Robert J. Canfield
*Attorney, Agent, or Firm*—Jacobson, Price, Holman & Stern

[57] ABSTRACT

A wrapping (1; 11) for plants or flowers placed in a pot like container (2), made from a resilient material of natural rigidity and consisting of a frustoconical tubular element open at both ends, the terminal portion at the tube end of smaller diameter having a retaining stop shoulder (4; 14) extending along at least a part of the circumference of the tubular element and defining a free internal opening which is smaller than that of an adjacent portion disposed in the direction of the tube end having the smaller diameter, which stop shoulder is formed by a local cut (3; 13) in the tubular element disposed in a plane substantially perpendicular to the central axis of the tubular element.

14 Claims, 3 Drawing Sheets

WRAPPING FOR PLANTS OR FLOWERS PLACED IN A POT LIKE CONTAINER

BACKGROUND OF THE INVENTION

This invention relates to a wrapping for plants and flowers placed in a potlike container, the wrapping being made from, a resilient material of natural rigidity and more particularly to such a wrapping in the form of a frustoconical tubular element open at both ends and having on the terminal portion at the tube end of smaller diameter a retaining stop shoulder for the potlike container, extending along at least a part of the circumference of the tubular element and defining a free passage which is smaller than that of an adjacent portion disposed in the direction of the tube end having the smaller diameter.

Such a wrapping is known from European patent specification Publication No. 0 262 708. Showing embodiments wherein a plurality of ridges or accordion grooves are provided adjacent the narrower end of the tube for retaining the edge of the potlike container. Such a configuration is tuned in particular to the manufacture of wrappings from a plastics material such as PVC. Because this known wrapping is a temporary wrapping material, the use therein of plastics, particularly PVC, meets with increasing resistance based on environmental considerations.

BRIEF SUMMARY OF THE INVENTION

The object of the invention is to improve such a wrapping so that it can be manufactured in a simpler manner, which also permits easier and more economical manufacture from material that is more environment-friendly than PVC, for instance paper or cardboard.

According to the present invention, this object is achieved by a wrapping of frustoconicle tubular form having a central axis and stop shoulder provided by a local cut in the tubular element, disposed in a plane substantially perpendicular to the axis of the tubular element. Owing to the natural rigidity of the resilient material from which the tubular element is made, this material, which has been given a round tubular shape, will spring back, i.e. radially inwardly, into a straighter shape at the point of the local cut and thereby form a stop shoulder which the upper edge of the potlike container must be pulled past. After this upper edge has passed the cut, the material adjacent the cut will spring back into its straighter position, thereby disallowing upward displacement of the potlike container. In turn, any displacement of the container in the direction of the end of smaller diameter is prevented by the tapering configuration of the tubular element. Thus, the potlike container is retained relative to the wrapping in the two directions of displacement. It is noted here that it is known per se from French patent application No. 2,477,107 to prevent displacement of potlike container in only one direction by using a tapering tubular element.

If only one local cut is provided, the wrapping may hinge on this single retaining provision and thus be pivoted back and forth over some distance. This is prevented in accordance with a further embodiment of the invention by providing a plurality of local cuts regularly spaced along the circumference of the tubular wrapping.

If the wrapping is made from material susceptible to tearing, such as paper, it is preferred, and in accordance with a further embodiment of the invention, that a transverse cut be provided at the end of each local cut, forming an angle therewith. The provision of such transverse cuts moreover improves the capacity of the stop shoulder to spring back resiliently into a straighter position, particularly so if each transverse cut extends perpendicularly to the local cut. It is further preferred that each local cut together with its transverse cuts forms an H- or U-shaped opening so that lip-shaped parts are formed which further increase the retaining effect.

To reduce the tolerance susceptibility of the cooperation between the potlike container and wrapping, it may be preferable, in accordance with a further embodiment of the invention, that at least two pairs of local cuts are present, the respective cuts of each pair being disposed diametrically opposite each other and the respective pairs of cuts being provided at different levels, viewed in the direction of the axis of the tube. These features combined with the stretch of the resilient material enable the compensation of virtually all manufacture-dependent deviations in the size of the pot or the wrapping.

Typically, a plurality of such potlike containers are arranged in a tray in virtual abutment with each other so as to use the available space as effectively as possible. Diverging tubular elements can disturb this configuration considering the circular upper ends of the tubular elements are wider than the circular passage at the upper edge of the potlike container. In order to enable the upper ends of the tubular elements to adjust more readily to the available space, it is preferable, in accordance with a further embodiment of the invention, that a plurality of creases or perforation lines be provided at regularly spaced intervals along the circumference of the tubular element, starting from the tube end having the larger diameter, which lines extend along a generatrix of the frustoconical tube surface. By virtue of these features, it is easier for the circular upper edge to deform into a configuration adjusted to the available space. These features and the effect obtained thereby are based on the same insight that has led to the realization of the stop shoulder according to the invention by means of the resilient material of natural rigidity, which has been given a rounded configuration but tends to assume a straighter position.

Optimum results can be achieved when, in accordance with a further preferred embodiment of the invention, four creases or perforation lines are provided and the distance between pairs of lines measured at the tube end having the larger diameter is equal to the side of a square having an inscribed circle of a radius substantially equal to the radius of a cross section of the tubular element at the level of the local cuts. In that event, the pattern of adjoining circles at the level of the upper edges of the potlike containers has been replaced by a pattern of adjoining squares at the level of the upper ends of the tubular elements. This step moreover provides for an optimum view of the plants or flowers placed in the containers, since virtually the entire surface is available for the purpose.

In order to facilitate the removal of a wrapping, it is preferable, in accordance with a further embodiment of the invention, that a cutout, for instance V-shaped, is provided at the point where a crease or perforation line starts from the tube end having the larger diameter.

A wrapping that is suitable for recycling and hence is environment-friendly is obtained if it is made from paper, cardboard or a similar material while the free tube edge adjacent the tube end having the smaller diameter is folded over. The folded lower edge increases tearing resistance and, especially if thicker types of material are used, may form a second stop shoulder limiting displacement of the pot in the direction of the tube end having the smaller diameter.

BRIEF DESCRIPTION OF THE DRAWINGS

The wrapping according to the invention will now be further described and discussed, by way of example, with reference to some embodiments as shown in the drawings wherein.

DETAILED DESCRIPTION

Figure 1:
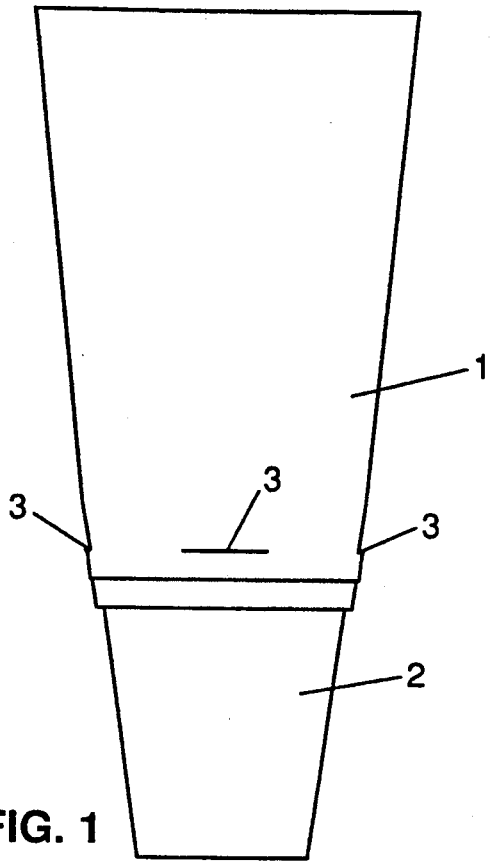
FIG. 1 is a side elevational view of a first embodiment of the wrapping placed on a potlike container.

In FIG. 1 a wrapping 1 is placed on a potlike container 2. The wrapping 1 is made from a resilient material of natural rigidity and consists of a tubular element in the shape of a truncated cone. Depending on the material used, the tubular element can be jointless or made from a blank bent into a round configuration.

For securing the wrapping 1 to the potlike container 2, retaining means are provided in the tubular element's terminal area adjacent the end having the smaller diameter. These retaining means comprise four local cuts or slits 3 regularly spaced along the circumference and all disposed in the same horizontal plane. It is noted that any desired number of cuts can be provided.

Figure 2:
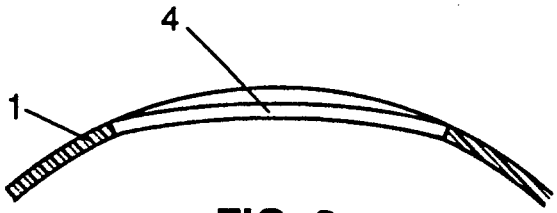
FIG. 2 is an enlarged horizontal fragmentary cross section of a detail of the wrapping shown in FIG. 1.
Figure 7:
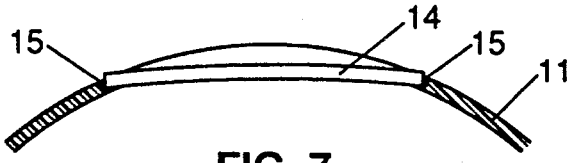
FIG. 7 is an enlarged horizontal fragmentary cross section of a detail of the wrapping according to FIGS. 4, 5 and 6.
Figure 6:
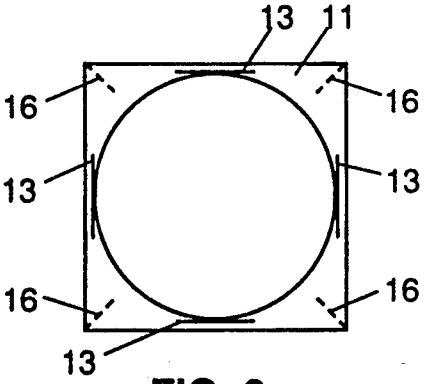
FIG. 6 is a top plan view of the wrapping shown in FIGS. 4 and 5, without a potlike container.

By providing the local cut or slit 3, the curved material, of the wall of the tubular element, as a result of the resilience and natural rigidity of the material will spring back, i.e. radially inwardly, into a straighter position at the adjacent wall portions along the length and between the ends of the cut, as shown in FIGS. 2 and 7 representing a bottom plan view of a cross section taken at the local cut, the tubular element being represented as a cylinder to show more clearly the wall portion that has sprung back. The spring-back of the wall results in a local narrowing or reduced diameter portion of the interior opening of the tubular element, so that, viewed along the inside wall of the tubular element, a bulging stop shoulder 4 is produced extending transversely thereto is obtained.

To couple the wrapping 1 to a potlike container 2, the container, with its lower end leading, is inserted into the wrapping via the wider passage of the tubular element and then released, whereafter gravity causes the potlike container 2 to extend beyond the narrower passage of the tubular element. Then the lower end of the potlike container 2 is gripped and pulled further from the wrapping until the wall of the pot is in contact with the wall of the tubular element throughout its circumference.

Figure 3:
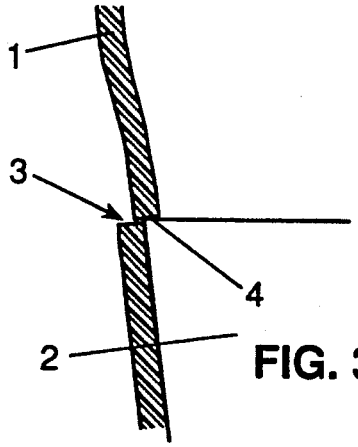
FIG. 3 is an enlarged vertical fragmentary cross-section of a detail of FIG. 1 showing the manner of cooperation between a wrapping and a potlike container.

Before reaching that position, the upper edge of the potlike container 2 reaches the level of the local cuts 3 where the wall portions adjacent the local cuts, which have sprung back inwardly, are pushed outwardly as a result of the pulling of the potlike container. The pulling of the potlike container 2 is continued until the upper edge thereof passes the local cuts 3, whereupon the wall portions above said cuts spring back into their straighter, or reduced diameter position again as shown in FIG. 2. Thus the stop shoulder 4, as shown in FIG. 3, comes to rest on the upper edge of the potlike container 2, thereby providing a locking arrangement preventing upward displacement of the potlike container 2 in the direction of the larger inlet of the wrapping 1. Further displacement in the other direction is prevented by the tapering configuration of the wrapping 1.

It will be clear that the lower end of such a wrapping must be designed to match a specific potlike container, more particularly the top diameter of the potlike container. If one and the same wrapping is to be used for pots of different top diameters or if adjustment to size tolerances is to be realized, such can be achieved by providing local cuts at different levels, it being preferred from the point of view of stability that at least two, substantially opposite cuts are provided at each level.

Figure 3A:
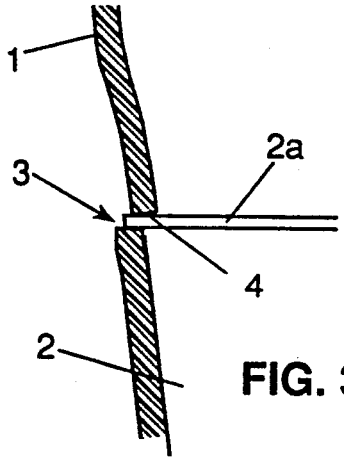
FIG. 3A is a view similar to FIG. 3 showing the cooperation of a wrapping and a potlike container of a slightly different shape.

Many potlike containers as used in practice comprise a projecting upper flange **2*a* as shown in FIG. 3A. Such a flange is often necessary to enable mechanized handling of the potlike containers. The presence of such a flange 2*a* improves the locking effect obtained, in that the bottom surface of this projecting flange 2*a* forms a further stop surface which, as shown in FIG. 3*a*, abuts against the edge of the cut facing the stop shoulder 4 and thereby prevents or at any rate hinders further displacement of the potlike container 2 in the direction of the smaller passage of the tubular element. Thus, the potlike container 2 is locked in two directions relative to the wrapping 1. The flange 2*a* now extends through the cut. This situation is obtained owing to the circumstance that the flange 2*a*, while being moved through the tubular element, first pushes out the wall portion above the cut 3, which has sprung back. Below the cut 3 there is also a wall portion which has sprung back but which is pushed out less far by the wall of the potlike container which extends less far outwardly. When the flange 2*a* arrives at the slit 3, the wall portion disposed above the slit can spring back. The flange 2*a* then abuts the lower edge of the slit, which is pushed out less far, so that the flange 2*a* has automatically entered a locked position, extending through the slit 3, as shown in FIG. 3**.

Another possibility of realizing adjustment to manufacturing tolerances is to provide a transverse cut at the ends of a local cut in the direction of the smaller and/or larger passage of the tubular element. In that case, the wall portion below and/or above the local cut allows slightly wider resilient deflection. A further advantage of such a transverse cut is that the chances that wrapping 1 will tear in the produced part of the local cut 3 are reduced.

Figure 4:
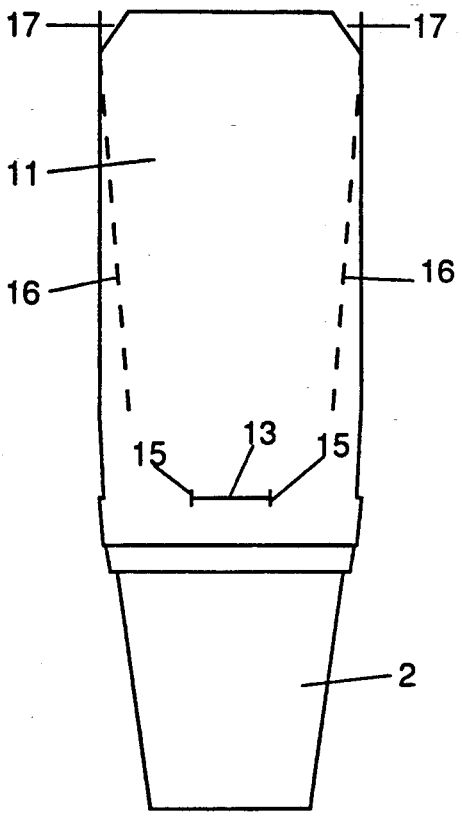
FIG. 4 is a side elevational view of a second embodiment of the wrapping placed on a potlike container.
Figure 5:
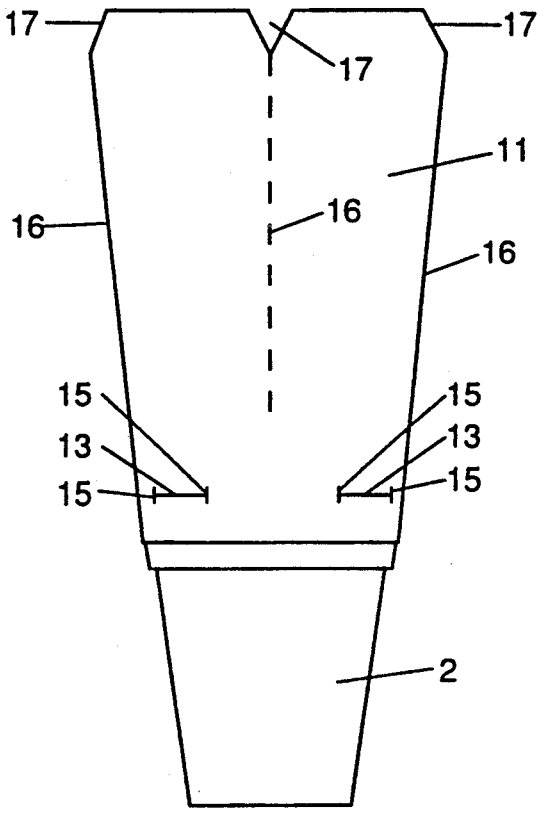
FIG. 5 is a view similar to FIG. 4 in which the wrapping and potlike container have been turned 45° relative to the vertical axis.

Such transverse cuts 15 are shown in the embodiment according to FIGS. 4 and 5, where the local cut 13 and the transverse cuts 15 together form an opening of substantially H-shaped configuration in the wall of the wrapping. As will appear from FIG. 7, in that case the stop shoulder 14, as well as the opposite edge of the cut, can spring back into a virtually straight form, viewed in elevation, which means that the locking effect is improved in that the free passage of the tubular element at the local cut 13 is smaller than in the absence of the transverse cuts.

In the embodiment according to FIGS. 4 and 5, a wrapping 11 is shown in which further advantageous use has been made of the effect that the resilient material of natural rigidity from which the wrapping 11 is made springs back from the rounded configuration. To that end, four perforate lines 16 have been provided at regularly spaced intervals along the circumference of the tubular element, which lines extend from the edge having the larger diameter along a generatrix of the tube surface in the direction of the edge having the smaller diameter, the perforate lines terminating preferably above the level of the local cuts. By providing perforate lines 16, the upper edge of the wrapping will spring back to assume a substantially square shape, at any rate a shape which is readily deformable into a square, while the portion of the wrapping adjacent the potlike container retains its round shape.

This is especially advantageous when a plurality of potlike containers 2 with wrappings 11 are to be arranged in a matrix in a tray, for instance for transportation from the nursery to the auction, from the auction to the retailer and from the retailer to the ultimate consumer. By providing for the round lower end of the wrapping 11 to terminate in a square, the potlike containers with wrappings can be arranged closer to each other without substantial deformation of the wrappings.

The trays are usually so designed that the upper edges of adjacent pots, disposed at a distance from the top surface of the trays, are in abutment with each other or substantially so. To ensure that the wrapping according to FIGS. 4 and 5 can also be used with such a tray without difficulty, the circumferential length of the larger passage of the tubular element is selected such that it equals the circumference of a square with an inscribed circle corresponding to the top surface of the potlike container 2. Thus, without deformation of the wrappings 11, an arrangement in groups can be obtained as shown in top plan view in FIG. 8, permitting each tray to accommodate a maximum number of potlike containers while substantially the entire top surface of the tray with potlike containers and wrappings remains available to permit visual inspection of the plants or flowers arranged therein. Further, the largely straight or planar sidewalls of the wrappings so obtained are eminently suitable for printing thereon all kinds of data regarding the type of plant, nursing instructions, the name of the nursery or the retailer, etc. A further important advantage of the use of such a wrapping is that in relation to the available space the plant sustains the least possible compression and can be kept separate from adjacent plants, which reduces the spread of diseases considerably.

The perforate lines 16 have a further advantage in that they permit simple removal of the wrapping, for instance by the consumer. To further improve the simple removal of the wrapping, V-shaped cutouts 17 have been provided at the beginning of each perforate line 16 in the upper edge of the wrapping. It goes without saying that these cutouts may have any other desired shape. Further, it is not necessary that a cutout be present at each perforate line 16. In principle, one cutout is sufficient to achieve the object referred to.

Figure 9:
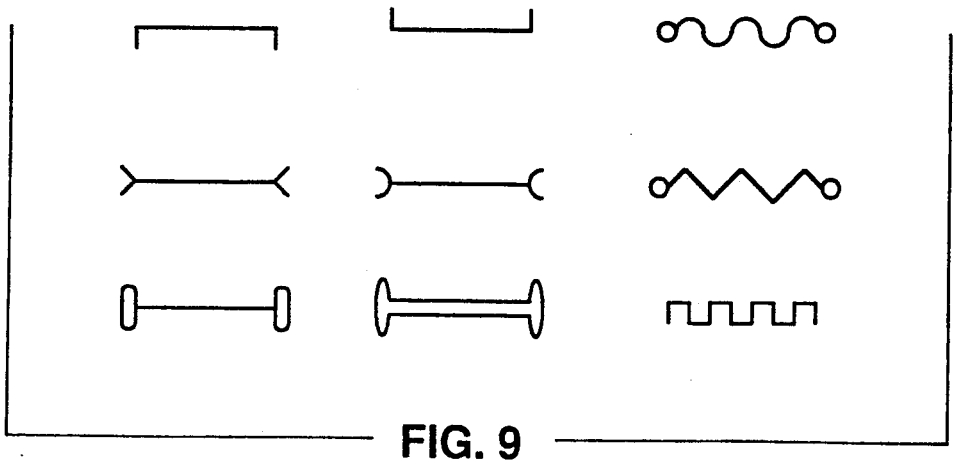
FIG. 9 shows a number of variant embodiments of a local cut in the wrapping.

Depending on the material used, the shape of the pot and similar factors, the configuration of the local cut, with or without transverse cuts, can be modified. A number of possible designs are shown in FIG. 9, but it is stressed that a great many other shapes are possible.

Figure 8:
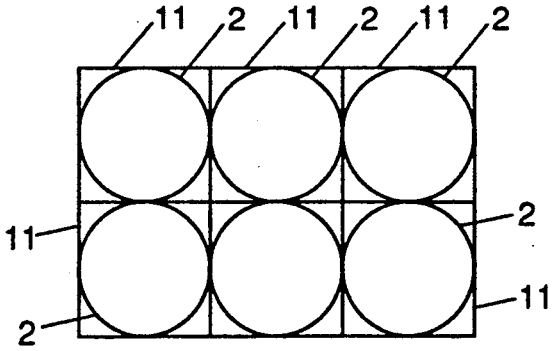
FIG. 8 is a schematic top plan view of six wrappings according to FIG. 6 arranged in a group.
Figure 5A:
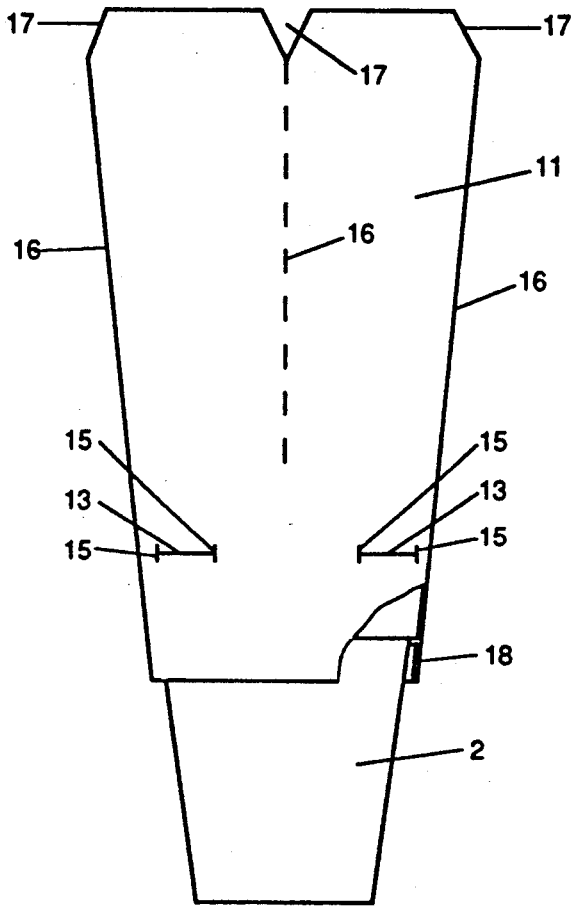
FIG. 5A is a view similar to FIG. 5 showing a different embodiment having a folded edge at the lower end.

It will be clear that within the framework of the invention, many further modifications and variants are conceivable. For instance, the figures show four perforate lines but any number may be chosen and any type of lines other than perforate lines may be chosen, provided the desired chief effect is realized, i.e. the wall portions on opposite sides of such a line must be capable of springing back from a curved position into a straighter or reduced diameter position. Examples of such alternative lines are creases or lines obtained by cutting the wall material halfway through. If, for instance, the containers are arranged in staggered relationship in the tray, for instance six perforate lines may be provided, so that the upper edge is of hexagonal configuration and a continuous pattern of upper edges as shown in FIG. 8 can likewise be obtained, namely a honeycomb structure. Further, it is possible to provide at least one further transverse cut. Further, for example as shown in FIG. 5A the lower edge 18 of the tubular element may be folded inwardly and upwardly and glued, which reduces the edge's susceptibility to tearing. To further improve the possibility of visually inspecting the packaged flowers or plants, one or more windows, which may or may not be covered with a transparent material, can be provided in the wall of the wrapping.

What we claim is:

1. A wrapping for plants or flowers placed in a pot like container having an upper edge, said wrapping being made from a resilient material of natural rigidity and comprising:

a frustoconical tubular element having a central axis, an open tube end of smaller diameter and an open tube end of larger diameter, said tube end of smaller diameter having a terminal portion; and retaining means on said terminal portion for said pot like container comprising at least one local cut extending in a substantially circumferential direction along a part of said tubular element and disposed in a plane substantially perpendicular to said central axis, edges on said tubular element on sides of said at least one local cut acing each other, and a stop shoulder on an edge at a side of said at least one local cut closer to said larger diameter tube end, said stop shoulder defining a free internal passage in said tubular element smaller than a free internal passage defined by an adjacent portion of said tubular element on a side of said at least one local cut closer to said smaller diameter tube end so that said stop shoulder is engageable with said upper edge of said pot like container when said container is inserted in said wrapping in use.

2. A wrapping as claimed in claim 1 wherein: a plurality of local cuts are spaced regularly in said circumferential direction.

3. A wrapping as claimed in claim 1 and further comprising:

a transverse cut at each end of said at least one local cut extending at an angle with respect to said at least one local cut.

4. A wrapping as claimed in claim 3, wherein:

each transverse cut extends perpendicularly to said at least one local cut.

5. A wrapping as claimed in claim 4, wherein:

said at least one local cut with said transverse cuts form an H-shape.

6. A wrapping as claimed in claim 4, wherein:

said at least one local cut with said transverse cuts form a U-shape.

7. A wrapping as claimed in claim 2, wherein:

a plurality of pairs of local cuts are provided;

the cuts of each pair of cuts are disposed diametrically opposite each other;

said pairs of cuts are arranged in groups of pairs; and each group of pairs of cuts is disposed at a different level than other groups of pairs, viewed along said central axis of said tubular element.

8. A wrapping as claimed in claim 1 and further comprising:

a plurality of perforation lines at circumferentially spaced intervals extending along said tubular element from said tube end of layer diameter a predetermined distance toward said tube end of smaller diameter.

9. A wrapping as claimed in claim 8, wherein:

four perforation lines are provided; and the distance between any two adjacent perforation lines measured at the tube end of larger diameter is substantially the length of a side of a square having an inscribed circle the radius of which is substantially equal to the radius of a cross section of said tubular element at the level of said at least one local cut.

10. A wrapping as claimed in claim 8 and further comprising:

a V-shaped cut out for at least one perforation line in said tubular element at said tube end of large diameter, said cut out having a bottom point intersected by said at least one perforation line.

11. A wrapping as claimed in claim 1 wherein:

said resilient material is selected from the group consisting of paper, cardboard, and plastic; and an end portion of said tube end of smaller diameter is folded over.

12. A wrapping as claimed in claim 1 and further comprising:

a plurality of creases at circumferentially spaced intervals extending along said tubular element in crease lines from said tube end of larger diameter a predetermined distance toward said tube end of smaller diameter.

13. A wrapping as claimed in claim 8, wherein:

four creases are provided; and, the length of said spaced intervals measured at the tube end of larger diameter is substantially the length of a side of a square having an inscribed circle the radius of which is substantially equal to the radius of a cross section of said tubular element at the level of said at least one local cut.

14. A wrapping as claimed in claim 8 and further comprising:

a V-shaped cut out for at least one crease line in said tubular element at said tube end of large diameter, said cut out having a bottom point intersected by said at least one crease line.

* * * * *